United States Patent [19]

Bridwell et al.

[11] 4,147,442

[45] Apr. 3, 1979

[54] SHAFT LOCKING APPARATUS

[75] Inventors: John W. Bridwell; Jimmy D. Myers, both of Morton, Ill.

[73] Assignee: Caterpillar Tractor Co., Peoria, Ill.

[21] Appl. No.: 901,407

[22] Filed: May 1, 1978

[51] Int. Cl.[2] ..... F16D 1/00; F16L 25/00

[52] U.S. Cl. ..... 403/4; 403/359; 414/694

[58] Field of Search ..... 403/4, 3, 359; 188/31; 214/138 R; 212/39

[56] References Cited

U.S. PATENT DOCUMENTS

| | | | |
|---|---|---|---|
| 1,109,836 | 9/1914 | Hanson | 403/4 |
| 1,929,397 | 10/1933 | Davidson | 188/31 X |
| 3,217,910 | 11/1965 | Waite | 214/138 R |
| 3,764,153 | 10/1973 | Miller | 403/359 X |
| 3,811,582 | 5/1974 | Shumaker et al. | 214/138 R |
| 3,896,884 | 7/1975 | Casey | 214/138 X |
| 3,908,843 | 9/1975 | Noller et al. | 214/138 X |
| 4,065,216 | 12/1977 | Nelson | 403/4 |

*Primary Examiner*—Wayne L. Shedd
*Attorney, Agent, or Firm*—John L. James

[57] ABSTRACT

Locking apparatus encloses and frees an end portion of a shaft for rotation at a first position of the apparatus relative to the shaft. The locking apparatus further encloses, engages, and prevents rotation of the shaft end portion at a second position of the apparatus relative to the shaft. Respective ends of the apparatus are oriented toward the shaft at the first and second positions. The first position of the locking apparatus permits rotation of the shaft and the second position prevents shaft rotation and related movement of associated implements.

6 Claims, 2 Drawing Figures

SHAFT LOCKING APPARATUS

BACKGROUND OF THE INVENTION

In the use of a rotatable shaft, it is desirable to controllably prevent rotation of the shaft and free the shaft for rotation. This permits the shaft to be locked into a position when not in use and also permits rotation of the shaft during use.

Commonly, a rotatable shaft is associated with a motor used to drive attachments on a work vehicle. For example, a motor is mounted in relationship with a backhoe implement to provide swing control of the implement. The motor and shaft are used to position the implement at a convenient working location by swinging the implement about an axis to the desired location.

When not in use, particularly during movement of the work vehicle from jobsite to jobsite, the backhoe implement is customarily moved to a certain position relative to the vehicle. It is desirable to securely maintain this position and prevent the implement from swinging freely in response to forces on the implement and shaft incurred during movement of the work vehicle. For example, the circuit pressure in a hydraulic motor positions the implement during use. When the implement is not in use, leakage can occur in the hydraulic system and permit rotation of the shaft. This situation is increased by forces on the implement tending to turn the shaft against the circuit pressure. This can result in undesirable movement of the implement, interference with the activities of the work vehicle, and a waste of time and labor in repositioning the implement.

Heretofore, a rack and pinion mechanism has been commonly used to control the implement. Maintaining the implement in a locked position has been accomplished by placing safety pins through corresponding openings in respective brackets on the work vehicle and implement. The use of a rotary motor and its associated shaft to control the backhoe implement provides further opportunity to securely and more conveniently lock the implement in position.

Therefore, it is desirable to provide means for controllably preventing rotation of the shaft and freeing the shaft for rotation. This locks the shaft and associated attachments in a particular position when not in use and permits rotation of the shaft during use, respectively.

SUMMARY OF THE INVENTION

According to the present invention, means is provided for enclosing and freeing an end portion of a shaft for rotation at a first position relative to the shaft and for enclosing, engaging, and preventing rotation of said shaft end portion at a second position of said means relative to the shaft. The means has one end oriented toward the shaft at the first position and another end oriented toward the shaft at the second position. Rotation of the shaft is permitted at the first position. Shaft rotation and related movement of associated implements is prevented in the second position.

DETAILED DESCRIPTION

Figure 1:
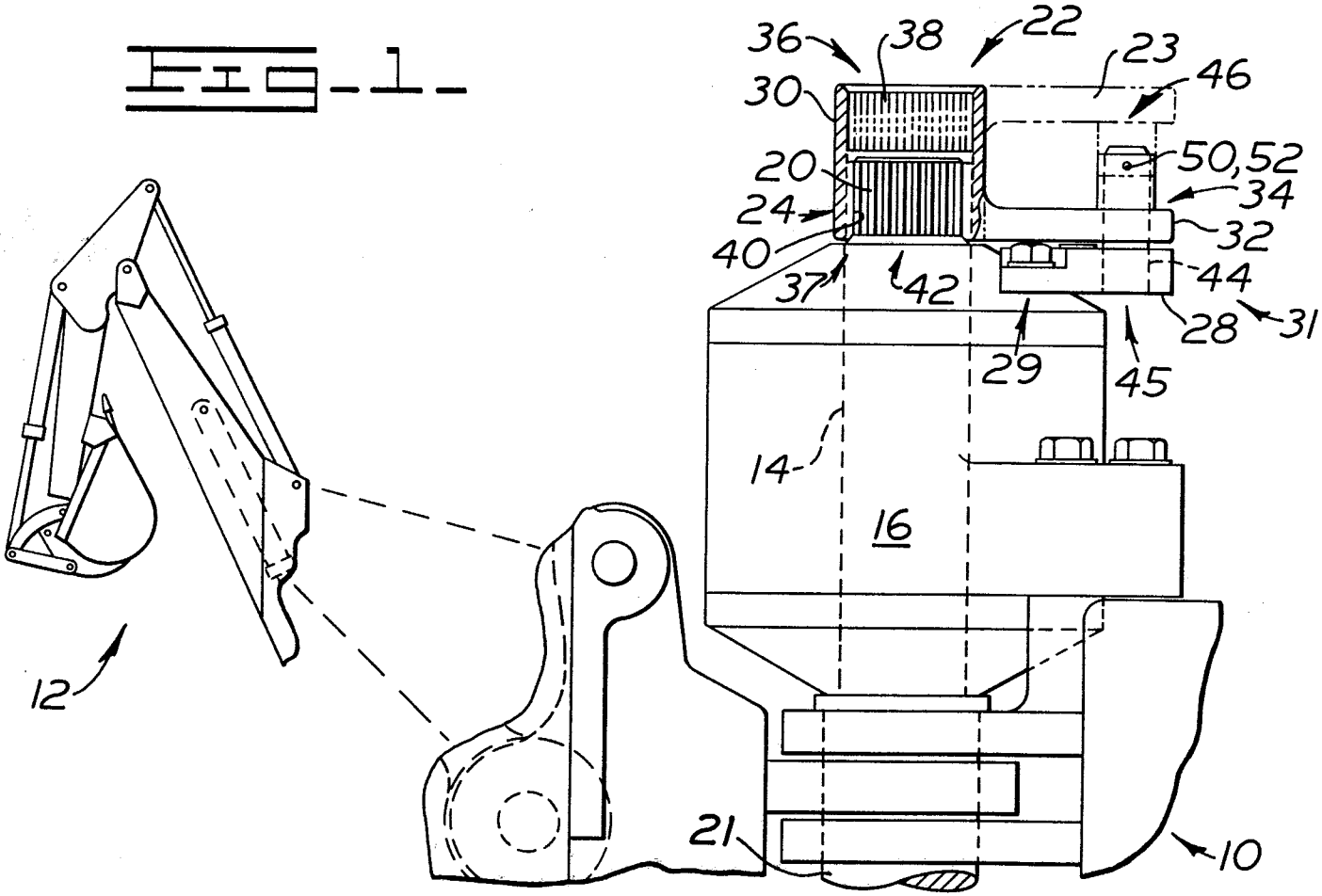
FIG. 1 is a diagrammatic view of the invention in association with an implement of a work vehicle.
Figure 2:
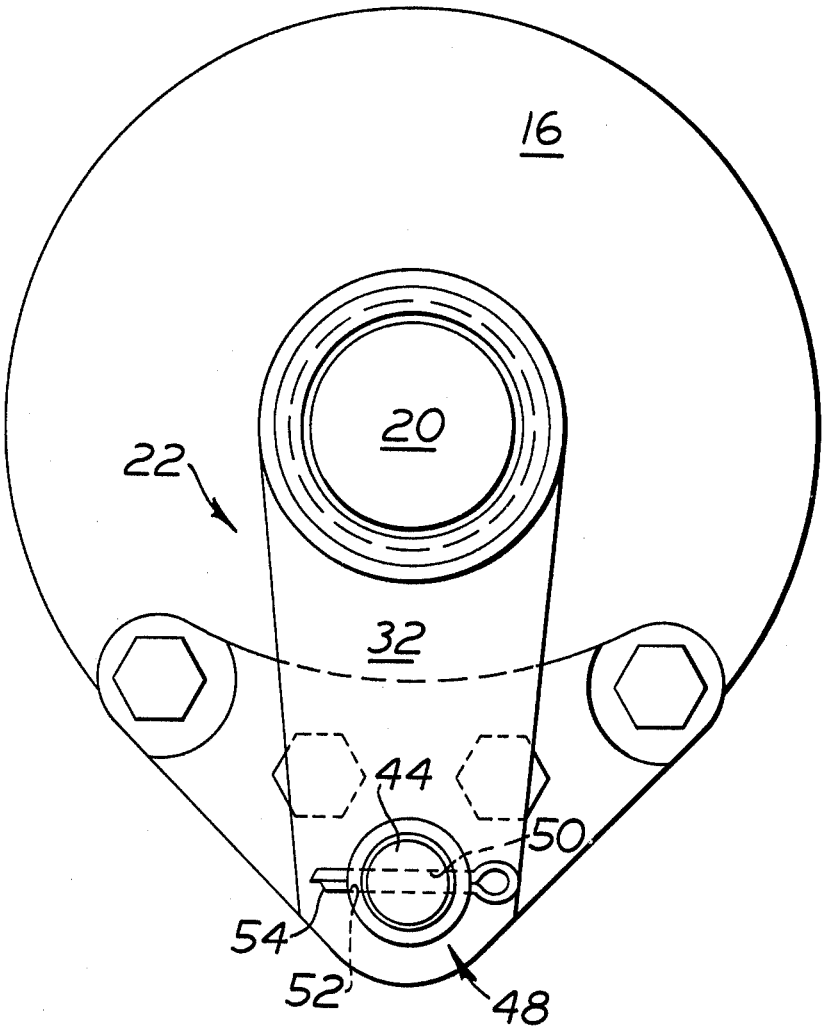
FIG. 2 is a diagrammatic view showing the invention in greater detail.

Referring to FIG. 1, a work vehicle 10 has a backhoe implement system 12. A motor or adjacent supporting structure 16 having a shaft 14 is used to control the horizontal swing positioning of the backhoe implement 12. Said motor 16 has an extended shaft end portion 20. A pivot shaft 21 is splined to the motor shaft 14. Said pivot shaft 21 is splined to the implement 12 a preselected distance from the shaft 14 (not shown) for controlling the swing positioning of the implement 12. In positioning the implement 12, the pivot shaft 21 also acts as a torque tube to provide a longer torque arm for relieving stresses on the motor 16 and implement system 12.

A locking apparatus 22 provides means 22 for enclosing and freeing the shaft end portion 20 for rotation at a first position 23 (shown in outline) of the means 22 relative to the shaft 14 and for enclosing, engaging, and preventing rotation of the shaft end portion 20 at a second position 24 of said means 22 relative to the shaft 14. The means 22 has one end oriented toward the shaft 14 at the first position 23 and has another end oriented toward the shaft 14 at the second position 24.

The means 22 includes a base 28, member 30, flange 32, and removable connecting means 34. It is desirable to connect the base 28 at one end portion 29 to the supporting structure 16 of the shaft 14 to permit swing positioning of the backhoe implement 12 in the first position 23 of the locking apparatus 22. The member 30 has first and second end portions 36,37. Preferably, said first end portion 36 is immediately opposite the second end portion 37. Said first end portion 36 has an opening 38 of dimensions sufficient for enclosing and being spaced from the shaft end portion 20. The second end portion 37 has an opening 40 of dimensions sufficient for enclosing the shaft end portion 20, and has means 42 for releasably fixing the member 30 to the shaft end portion 20.

Preferably, the shaft end portion 20 is splined and the releasable fixing means 42 of the member 30 has splines extending inwardly into the opening 40 and mateable with the shaft end portion 20. Such mating spline configurations are well known in the art. Other enclosing and engaging configurations can be used without departing from this invention.

The flange 32 is connected at one end portion to the member 30. Means 34 is provided for removably connecting the flange 32 to the base 28. Preferably, the means 34 includes an arm 44 connected at a first end portion 45 to the other end portion 31 of the base 28. The flange 32 has an opening at the other end portion of said flange 32 for receiving the arm second end portion 46.

It is desirable that means 48 be provided to releasably connect the arm 44 to the flange 32. Preferably, the arm 44 and flange 32 each have openings 50,52 that are substantially coaxial at the first and second positions 23, 24 of the member 30. The releasable connecting means 48 is a pin 54 removably positioned through the openings 50,52 of the flange 32 and the arm 44.

OPERATION

In the operation of the locking apparatus 22, said apparatus 22 is positionable relative to the shaft at a first position 23 for use of the motor 16 and implement system 12 and at a second position 24 for preventing shaft rotation and swinging movement of the implement system 12.

As shown, in the second or locked position 24, one end 37 of the apparatus 22 is positioned to enclose and engage the shaft end portion 20. The pin 54 is placed through openings 50,52 to secure the apparatus 22 in the second position 24. The spline engagement between the shaft 14 and the locking apparatus 22 substantially resists rotation of the shaft 14. This prevents the implement 12 from moving from the locked position.

The locking apparatus 22 is placed in the first position 23 to allow rotation of the shaft 14 and positioning of the implement 12 with the motor 16. The pin 54 is removed and the apparatus 22 is removed and reversed. The other end 36 encloses and is spaced from the shaft 14. The pin 54 is replaced in the openings 50,52 of the arm 44 and flange 32, respectively. In this position 23, the shaft 14 is rotatable and the shaft end portion 20 is protected by the apparatus 22. Also, the locking apparatus 22 is conveniently stored and available for immediate use in locking said shaft 14 and preventing movement of the implement 12.

Other aspects, objects, and advantages of this invention can be obtained from a study of the drawings, the disclosure and the appended claims.

The embodiments of the invention in which an exclusive property or privilege is claimed are defined as follows:

1. Locking apparatus for controllably preventing rotation of a shaft and freeing the shaft for rotation, said shaft having an end portion and an adjacent supporting structure, comprising:

means for enclosing and freeing the shaft end portion for rotation at a first position of the means relative to the shaft and for enclosing, engaging, and preventing rotation of said shaft end portion at a second position of said means relative to the shaft, said means having one end oriented toward the shaft at the first position and having another end oriented toward the shaft at the second position.

2. Locking apparatus, as set forth in claim 1, wherein said means includes a base having first and second end portions and being connectable to the supporting structure of the shaft;

a member having first and second end portions, said first end portion having an opening of dimensions sufficient for enclosing and being spaced from said shaft end portion, said second end portion having an opening of dimensions sufficient for enclosing said shaft end portion and means for releasably fixing the member to the shaft end portion;

a flange having first and second end portions and being connected at the second end portion to the member; and means for removably connecting said flange to the base

3. Locking apparatus, as set forth in claim 2, wherein said first end portion of the member is immediately opposite said second end portion.

4. Locking apparatus, as set forth in claim 2, wherein said shaft end portion is splined; and the releasable fixing means of said member second end portion has splines extending inwardly into said opening and being mateable with the splines of the shaft end portion.

5. Locking apparatus, as set forth in claim 2, wherein said removable connecting means includes:

an arm having first and second end portions and being connected at the first end portion to the second end portion of the base;

said flange first end portion having an opening for receiving the second end portion of the arm at the first and second positions of the member; and means for releasably connecting the arm to the flange.

6. Locking apparatus, as set forth in claim 4, wherein said flange and arm each have openings that are substantially coaxial at the first and second positions of the member; and the releasable connecting means is a pin removably positioned through the openings of the flange and arm.

* * * * *